US009828999B2

(12) United States Patent
Andersson et al.

(10) Patent No.: US 9,828,999 B2
(45) Date of Patent: Nov. 28, 2017

(54) PUMP FOR PUMPING LIQUID AS WELL AS AN IMPELLER ASSEMBLY

(71) Applicant: XYLEM IP MANAGEMENT S.à r.l., Senningerberg (LU)

(72) Inventors: Patrik Andersson, Skogås (SE); Stefan Ramström, Vallentuna (SE)

(73) Assignee: XYLEM IP MANAGEMENT S.Á R.L., Senningerberg (LU)

( * ) Notice: Subject to any disclaimer, the term of this patent is extended or adjusted under 35 U.S.C. 154(b) by 0 days.

(21) Appl. No.: 14/911,935

(22) PCT Filed: Aug. 6, 2014

(86) PCT No.: PCT/IB2014/063731
§ 371 (c)(1),
(2) Date: Feb. 12, 2016

(87) PCT Pub. No.: WO2015/022601
PCT Pub. Date: Feb. 19, 2015

(65) Prior Publication Data

US 2016/0195091 A1 Jul. 7, 2016

(30) Foreign Application Priority Data

Aug. 15, 2013 (SE) ..... 1350958-3

(51) Int. Cl.
*F04D 7/04* (2006.01)
*F04D 15/00* (2006.01)
(Continued)

(52) U.S. Cl.
CPC ..... *F04D 7/045* (2013.01); *F04D 3/00* (2013.01); *F04D 15/0033* (2013.01);
(Continued)

(58) Field of Classification Search
CPC ..... F04D 7/04; F04D 7/045; F04D 15/0033; F04D 15/0038; F04D 29/042; F04D 29/052; F04D 29/20
See application file for complete search history.

(56) References Cited

U.S. PATENT DOCUMENTS 2,245,866 A 6/1941 McLachlan
3,711,218 A 1/1973 Kennel
(Continued)

FOREIGN PATENT DOCUMENTS

DE 20115516 11/2001
EP 1026405 8/2000
(Continued)

OTHER PUBLICATIONS

International Preliminary Report on Patentability for International Application No. PCT/IB2014/063731 dated Nov. 23, 2015.
(Continued)

*Primary Examiner* — Gregory Anderson
*Assistant Examiner* — Juan G Flores
(74) *Attorney, Agent, or Firm* — RatnerPrestia

(57) ABSTRACT

An impeller assembly and a pump for pumping a liquid, including a pump chamber and an impeller arranged to rotate in the pump chamber, the impeller being suspended in a lower end of an axially extending drive shaft unit, wherein the lower end of the drive shaft unit is received in a cylinder-shaped recess of the impeller, wherein the impeller is displaceable back and forth in the axial direction in relation to the drive shaft unit. The impeller further includes an axially extending hole that connects the cylinder-shaped recess and the pump chamber and that the drive shaft unit includes an axially extending pin that projects from the lower end of the drive shaft unit, wherein the pin is arranged in the hole.

12 Claims, 4 Drawing Sheets

Figure 1:
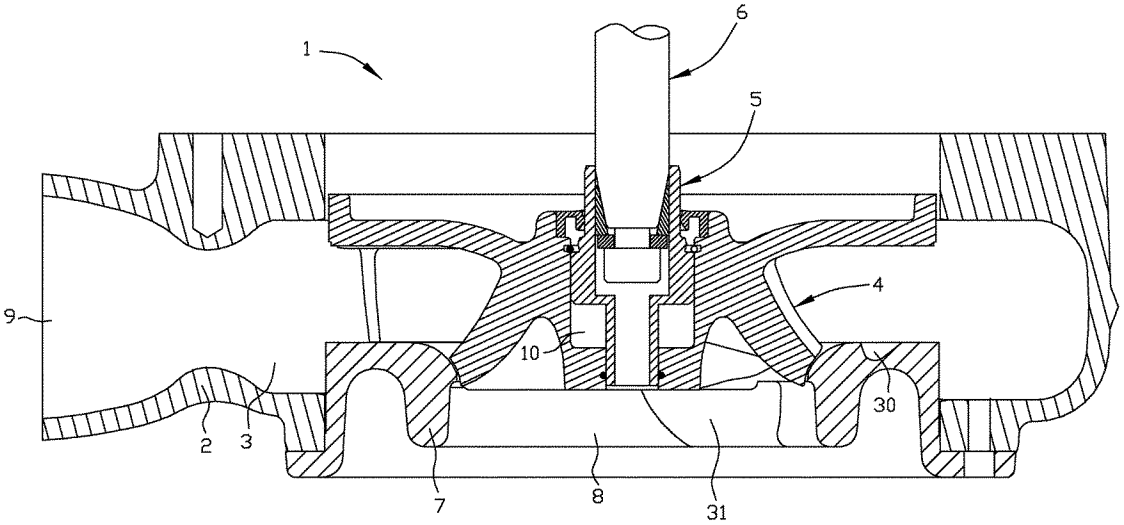

(51) Int. Cl.

| | |
|---|---|
| ***F04D 29/042*** | (2006.01) |
| ***F04D 29/20*** | (2006.01) |
| ***F04D 3/00*** | (2006.01) |
| ***F04D 29/52*** | (2006.01) |

(52) U.S. Cl.
CPC ..... *F04D 29/042* (2013.01); *F04D 29/20* (2013.01); *F04D 29/528* (2013.01)

(56) References Cited

U.S. PATENT DOCUMENTS

| | | | | |
|---|---|---|---|---|
| 3,771,927 | A | 11/1973 | Schiller | |
| 4,130,374 | A * | 12/1978 | Bingler | F04D 29/20 415/131 |
| 4,890,946 | A * | 1/1990 | von Pragenau | F01D 5/025 403/13 |
| 5,431,340 | A * | 7/1995 | Schirpke | B60H 1/08 237/12.3 B |
| 6,305,906 | B1 * | 10/2001 | Ekstrom | F04D 29/20 403/371 |
| 7,488,137 | B2 * | 2/2009 | Hu | F16D 1/096 277/622 |
| 2003/0072650 | A1 | 4/2003 | Madsen | |
| 2009/0022582 | A1 | 1/2009 | Andersson | |
| 2009/0123270 | A1 | 5/2009 | Andersson | |

FOREIGN PATENT DOCUMENTS

| | | |
|---|---|---|
| EP | 1247990 | 10/2002 |
| EP | 1899609 | 3/2008 |
| EP | 2535589 | 12/2012 |
| SE | 527964 | 7/2006 |
| SE | 530785 | 9/2008 |

OTHER PUBLICATIONS

International Search Report for International Application No. PCT/IB2014/063731 dated Jan. 30, 2015.

Written Opinion of the International Preliminary Examining Authority for International Application No. PCT/IB2014/063731, dated Sep. 10, 2015.

Written Opinion of the International Searching Authority for International Application No. PCT/IB2014/063731, dated Jan. 30, 2015.

* cited by examiner

PUMP FOR PUMPING LIQUID AS WELL AS AN IMPELLER ASSEMBLY

CROSS-REFERENCE TO RELATED APPLICATIONS

This patent application is a U.S. National Phase Patent Application of PCT Application No. PCT/IB2014/063731, filed Aug. 6, 2014, which claims priority to Swedish Patent Application No. 1350958-3, filed Aug. 15, 2013, each of which is incorporated by reference herein in its entirety.

TECHNICAL FIELD OF THE INVENTION

The present invention relates, in general, to a pump for pumping liquid, and in particular to a pump for pumping contaminated liquid comprising solid matter, such as sewage water which may comprise polymers, hygiene articles, fabrics, rags etc.

In accordance with a first aspect, the present invention relates to a pump for pumping liquid, comprising a pump chamber and an impeller arranged to rotate in said pump chamber, said impeller being suspended in a lower end of an axially extending drive shaft unit, wherein said lower end of the drive shaft unit is received in a cylinder-shaped recess of the impeller, wherein the impeller is displaceable back and forth in the axial direction in relation to the drive shaft unit, and wherein the impeller comprises an axially extending hole that connects the cylinder-shaped recess and the pump chamber.

In accordance with a second aspect, the present invention relates to an impeller assembly for placement in a pump chamber of a pump for pumping liquid.

BACKGROUND OF THE INVENTION AND STATE OF THE ART

In plants such as sewage treatment plants, septic tanks, wells etc., it occurs that solid matter or other contaminations such as socks, sanitary towels, paper etc. obstruct the pump of the plant, for example a submersible pump that is submerged in the basin/receptacle of the plant. When the impeller and the impeller seat are positioned at a fixed distance from each other, the pollutants are sometimes too large to pass through the pump. Large pieces of solid matter may in worst case cause the impeller to wedge, thus seriously damaging the pump. Such an unintentional shutdown is costly since it entails expensive, tedious and unplanned maintenance work.

European patent EP 1,899,609 discloses a pump comprising a pump chamber with a rotatable impeller, said impeller being suspended by a drive shaft, and an impeller seat/suction cover. The impeller is movable in the axial direction in relation to the impeller seat so that it may allow larger pieces of solid matter to pass through, pieces that otherwise would block the pump or wedge the impeller. The impeller has a cylinder-shaped recess in which the lower end of the drive shaft unit is received, and the impeller is displaceable in the axial direction between a lower and an upper position. The impeller also has an axially extending hole that connects the cylinder-shaped recess and the pump chamber so as to allow for introduction of a suitable tool in order to connect the impeller to the drive shaft.

When the pump is in operation said through-hole is provided with a plug/cover so as to prevent that the pumped liquid and pieces of solid matter enter the cylinder-shaped recess. Nonetheless, it sometimes occurs when pump is being serviced, e.g. due to readjustment of the axial gap present between the impeller and the impeller seat, that the importance of remounting said plug before the pump is restarted is overlooked. Once the pumped liquid enters the cylinder-shaped recess of the impeller, the constituting parts eventually corrode which, in turn, entails that the axial displaceability between the impeller and the drive shaft is adversely affected or becomes completely impossible. Moreover, pieces of solid matter may enter the cylinder-shaped recess which may mechanically prevent axial displacement of the impeller in relation to the drive shaft.

Furthermore, the interface between the impeller and the drive shaft unit has relatively small extension, i.e. radial abutment between the drive shaft unit and the cylinder-shaped recess, which entails that the impeller runs the risk of becoming tilted once subjected to an axially applied asymmetrical force.

It should also be mentioned that submersible pumps of the above kind are used to pump liquid from basins that are difficult to maintain and that pumps often operate for 12 or more hours daily. It is therefore utterly desirable to provide a pump with long working life.

SHORT DESCRIPTION OF THE OBJECT OF THE INVENTION

The present invention aims at obviating above-mentioned disadvantages and failings of previously known pumps and to provide an improved pump. A primary object of the invention is to provide an improved pump and impeller assembly of the type defined in the introduction, wherein the impeller has means for completely eliminating the risk of the pumped liquid and pieces of solid matter entering the cylinder-shaped recess of the impeller.

A further object of the present invention is to provide a pump and an impeller assembly where the impeller doesn't run the risk of becoming tilted as a consequence of asymmetrically applied force acting in the axial direction against the impeller.

It is also an object of the present invention to provide an improved pump of the type as defined in the introduction, wherein said pump in a reliable manner allows big pieces of solid matter to pass through the pump.

SHORT DESCRIPTION OF THE INVENTIVE FEATURES

In accordance with the invention, at least the primary object is achieved by means of the pump as defined in the introduction, having the inventive features defined in the independent claims. Preferred embodiments of the present invention are further defined in the dependent claims.

In accordance with the invention, a pump of the type defined in the introduction is provided, said pump being characterized in that the drive shaft unit comprises an axially extending pin that projects from said lower end of the drive shaft unit, wherein said pin is arranged in said hole and arranged to prevent that the pumped liquid enters the cylinder-shaped recess of the impeller.

Hence, the present invention is based on the understanding that, by arranging a pin that at all times is present in the through-hole of the impeller, the pumped liquid and solid matter are prevented from entering the cylinder-shaped recess and adversely affect the operation of the pump.

According to a preferred embodiment of the present invention, a liquid sealing is arranged at the interface of said hole and said pin.

According to a preferred embodiment, a lateral surface of the pin abuts an inner surface of the hole. This entails that the guidance between the drive shaft unit and the impeller has a greater extension in the axial direction with the purpose of eliminating the risk of tilting the impeller when an axial force is asymmetrically applied.

According to a preferred embodiment, the drive shaft unit comprises a drive shaft and a sleeve, wherein the sleeve surrounds and is releasably connected to the drive shaft and makes up part of the lower end of the drive shaft unit. This entails that the sleeve may be mounted in the cylinder-shaped recess of the impeller while the impeller assembly is being assembled, whereby the impeller assembly may be sold as an upgrading kit for existing pumps with axially displaceable impeller.

Further advantages and inventive features of the invention will be made clear from the remaining dependent claims and from the following, detailed description of preferred embodiments.

FURTHER ELUCIDATION OF PRIOR ART

Document U.S. Pat. No. 2,245,866 disclose a conventional pump having an impeller that is fixed to the lower/free end of the drive shaft, the pump has no means arranged to prevent the pumped liquid present in the pump chamber to enter the cylinder-shaped recess of the impeller, in which the lower end of the drive shaft is terminated.

SHORT DESCRIPTION OF THE DRAWINGS

Figure 2:
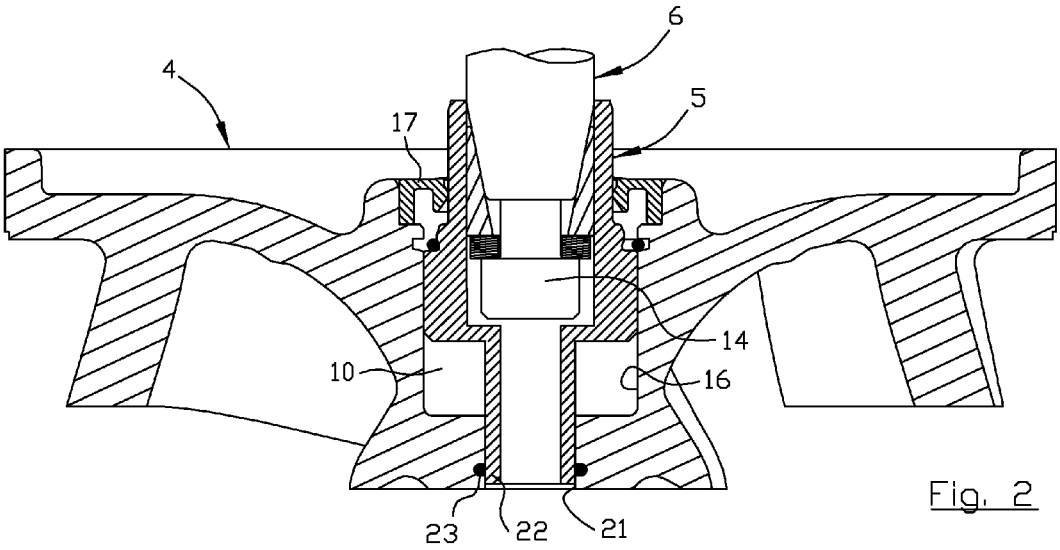
Figure 3:
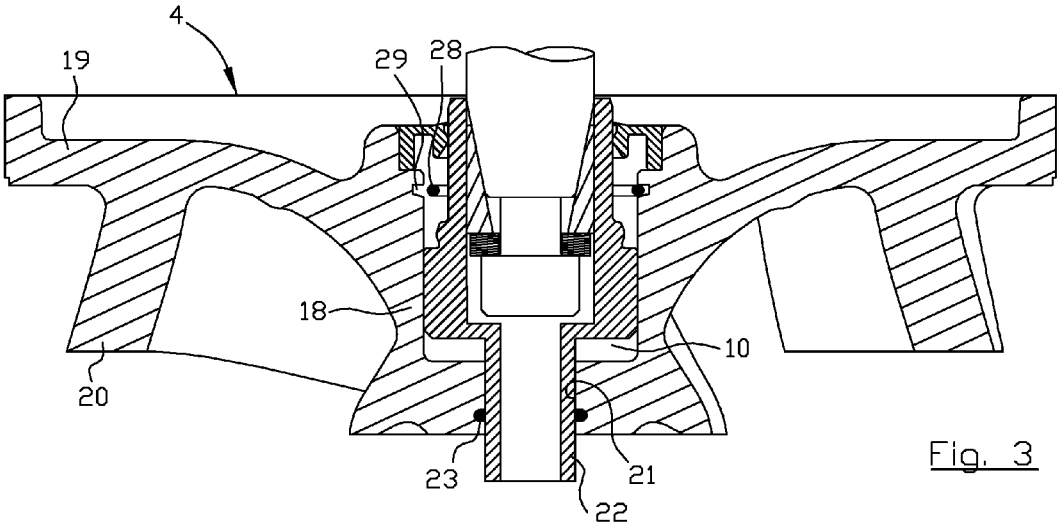
Figure 4:
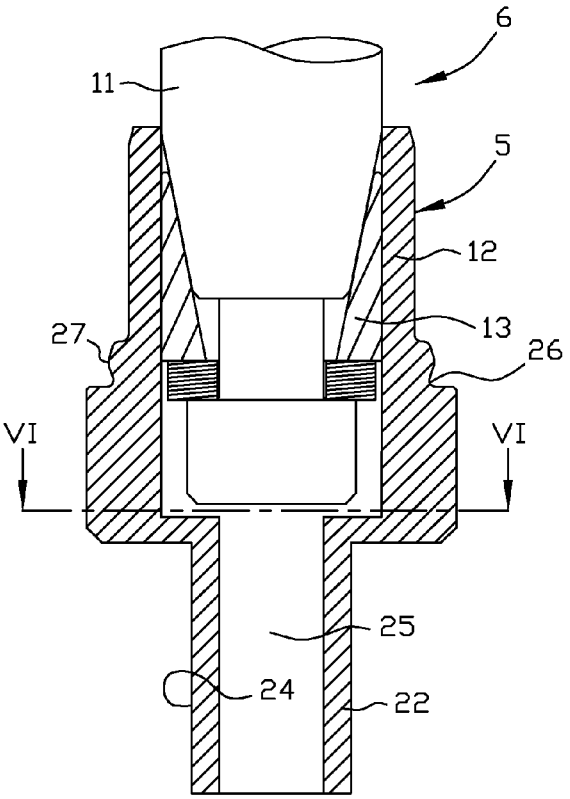
Figure 5:
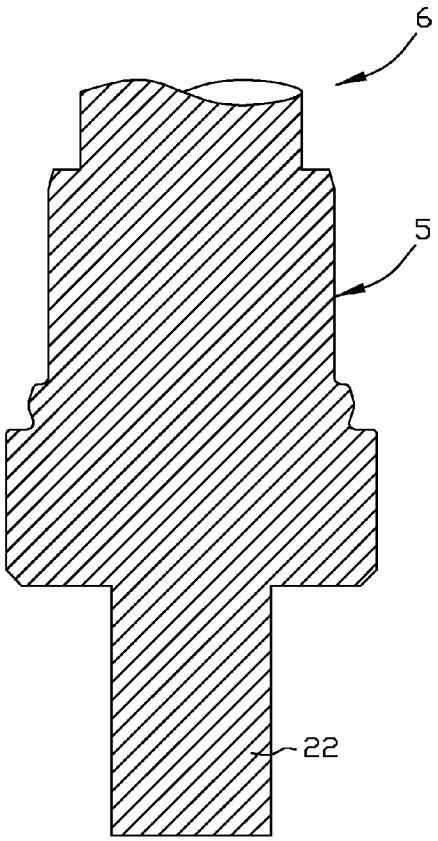
Figure 6:
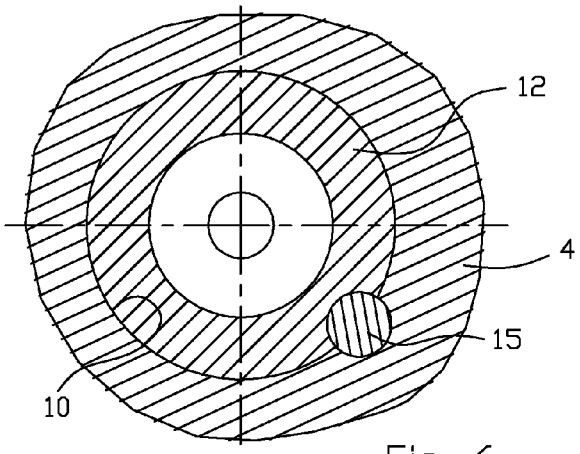
Figure 7:
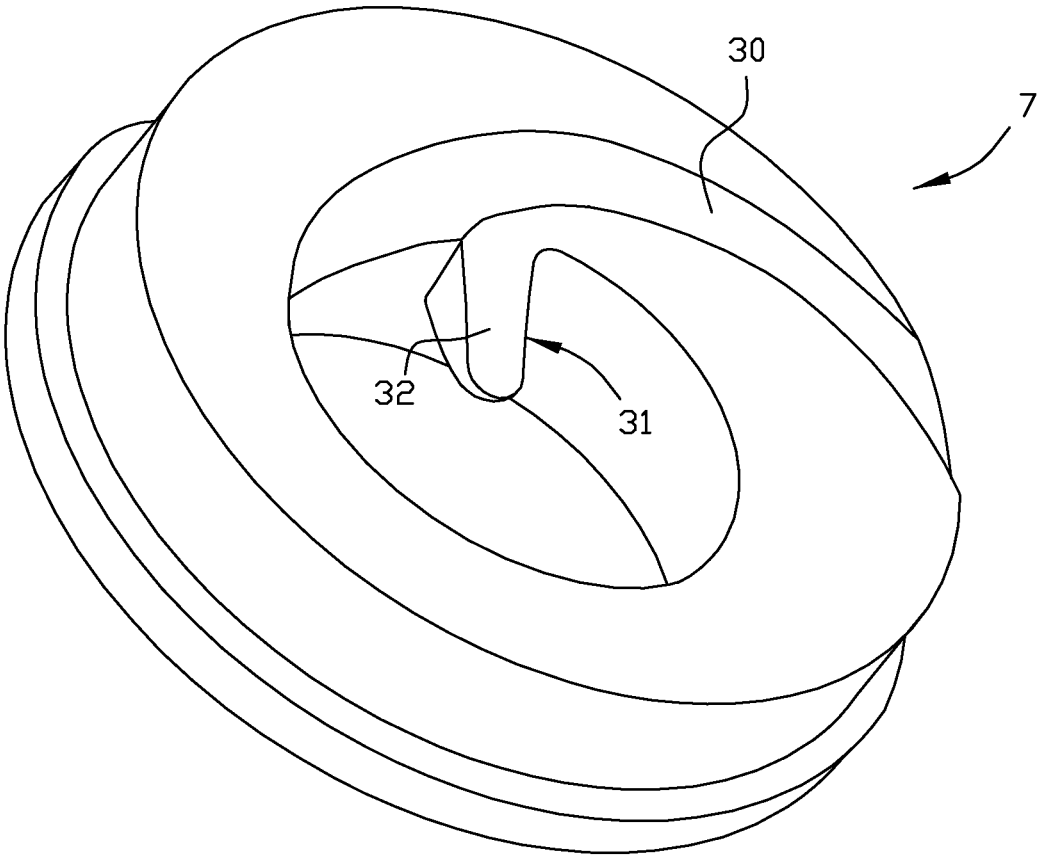

A more complete understanding of the above-mentioned and other features as well as advantages of the present invention will be clear from the following, detailed description of the preferred embodiments with reference to the accompanying drawings, wherein:

FIG. 1 is a schematic cutaway side view of a hydraulic unit belonging to a pump according to the present invention, the figure showing the impeller in a lower position, which corresponds to a normal position of operation, FIG. 2 is a schematic cutaway side view of an inventive impeller assembly and a drive shaft, wherein the impeller is in the lower position, FIG. 3 is a schematic cutaway side view of an inventive impeller assembly corresponding to FIG. 2, wherein the impeller is in a position at a distance from the lower position, FIG. 4 is a schematic cutaway side view of the drive shaft unit according to a first embodiment, FIG. 5 is a schematic cutaway side view of the drive shaft unit according to a second embodiment, FIG. 6 is a schematic cutaway view from above of the drive shaft unit corresponding to FIG. 4, taken along the line VI-VI, as well as a part of the impeller, and FIG. 7 is a schematic perspective view from above of an impeller seat.

DETAILED DESCRIPTION OF THE PREFERRED EMBODIMENTS

Reference is initially made to FIG. 1, where a part of an inventive pump is shown, more specifically its hydraulic unit, generally designated 1. In FIG. 1, the remaining parts of the pump are removed for the sake of clarity. These parts are inter alia a drive unit and a sealing unit positioned between the hydraulic unit and the drive unit. The present invention relates in general to pumps, but in the preferred embodiment the pump is a submersible, centrifugal pump. The present invention will be described in conjunction with such a pump, without in any way being limited thereto.

The hydraulic unit 1 comprises a pump chamber or volute 2 that delimits a pump chamber 3, an impeller 4 arranged to rotate in said pump chamber 3, the impeller being suspended in a lower end 5 of an axially extending drive shaft unit, generally designated 6, and a suction cover 7 with a centrally located inlet opening 8 for incoming liquid flow. The suction cover 7, also known as the impeller seat, is preferably releasably connected to the pump chamber 2, e.g. by means of a plurality of bolts, in such a way that the suction cover 7 cannot rotate relative the pump chamber 2. The impeller 4 is rotatably driven by the drive shaft unit 6 when the pump is in operation. Furthermore, the pump chamber 2 comprises an outlet opening 9 for outgoing liquid flow, said outlet opening 9 being radially directed in the shown embodiment.

According to the preferred embodiment, the impeller 4 is displaceable back and forth in the axial direction, between a lower position (shown in FIG. 1) and an upper position, in relation to the drive shaft unit 6. When the impeller 4 is displaced from the lower position, the impeller 4 is displaced in direction away from the suction cover 7 so as to let pass big pieces of solid matter present in the pumped liquid.

Now, reference is primarily made to FIGS. 2 and 3 showing the inventive impeller 4. The impeller 4 shown in FIG. 2 is positioned in the lower position and in FIG. 3 the impeller 4 is positioned at a distance from the lower position. As discussed above, when the impeller 4 is positioned in the upper position, the impeller 4 may have been displaced even further in relation to the drive shaft unit 6 then the position shown in FIG. 3. The impeller 4 comprises a cylinder-shaped recess 10, the lower end 5 of the drive shaft unit 6 is received in said cylinder-shaped recess 10.

The reference is now made to FIGS. 4-6. In the embodiment shown in FIG. 4 the drive shaft unit 6 comprises a drive shaft 11 and a sleeve 12, wherein the sleeve 12 surrounds and is releasably connected to the drive shaft 11. Hence, the sleeve 12 makes up part of the lower end 5 of the drive shaft unit 6. The sleeve 12 is connected to the drive shaft 11 in any suitable way, and in the shown embodiment the sleeve 12 is connected to the drive shaft 11 by means of a conventional tool cone 13. The drive shaft 11 is cone-shaped and the tool cone 13 is pressed onto the drive shaft 11 using a bolt 14 that is in engagement with the drive shaft 11 and is tightened, whereupon the tool cone 13 is forced radially outwards such that the sleeve 12 is braced or clamped on the drive shaft 11. The advantage of this embodiment is that the axial position between the sleeve 12 and the drive shaft 11 may be adjusted by loosening the bolt 14, axially displacing the sleeve 12 and subsequently retightening the bolt 14. In the embodiment shown in FIG. 5 the drive shaft unit 6 is a homogenous detail that makes up the lower end 5 of the drive shaft unit 6.

According to another, not shown embodiment, the sleeve 12 is screwed onto the end of a cylinder-shaped, non-conical, drive shaft 11 and this embodiment entails adjustment of the axial position between the sleeve 12 and the drive shaft 11 by arranging a desired number of spacing shims between the sleeve 12 and the drive shaft 11. It should here be mentioned that this embodiment functions and is perceived as if the lower end 5 of the drive shaft unit 6 is made up of a homogenous detail when the latter is mounted.

The drive shaft unit 6 and the impeller 4 are jointly rotatable. In the embodiment shown in FIG. 6 the pump comprises a carrier in the shape of a rod or pin 15, positioned at the interface of the lower end 5 of the drive shaft unit 6 and the cylinder-shaped recess 10 of the impeller 4. The rod 15 is positioned in oppositely arranged recesses of the lateral surface of the lower end 5 of the drive shaft unit 6 and of an inner surface 16 of the cylinder-shaped recess 10. According to an alternative embodiment, a plurality of rods 15, or carriers, may be distributed along said interface, preferably equidistantly distributed. The carrier may be fixedly connected with, or be a part of, the lower end 5 of the drive shaft unit 6. In an alternative, not shown embodiment, a spline coupling is arranged at said interface. According to a further, not shown embodiment, said interface has, when viewed in a radially extending plane, a polygonal basic shape, e.g. quadrangular or hexagonal.

The lower end 5 of the drive shaft unit 6 has in a preferred embodiment a lower, thicker part/section, the lateral surface of which radially abutting an inner surface 16 of the cylinder-shaped recess 10, and an upper, thinner part/section, the lateral surface of which is radially positioned at a distance from the inner surface 16 of the cylinder-shaped recess 10. The lower, thicker part guides the impeller 4 so that it doesn't become tilted relative the rotational axis of the pump.

An annular sealing 17 is arranged in the upper part of the cylinder-shaped recess 10 of the impeller, said sealing 17 abutting the lower end 5 of the drive shaft unit 6, or alternatively abutting the drive shaft 11 and preventing that the pumped liquid and solid matter enter the cylinder-shaped recess 10 from above.

The impeller 4 is preferably of the open type and comprises a hub 18, an upper cover plate 19 and at least one blade 20, also known as vane, extending in the axial direction from the cover plate 19. The blade 20 is preferably spiral-shaped in a direction that is opposite to normal direction of rotation of the impeller 4, i.e. direction of rotation when the pump is in normal operation. The number of blades 20 and their length may vary significantly so as to fit different liquids and fields of application. The cylinder-shaped recess 10 is preferably arranged in the hub 18. Said at least one blade 20 is in the shown embodiment also connected to said hub 18 and, in the preferred embodiment, the impeller 4 comprises two blades 20. Furthermore, the impeller 4 comprises a hole 21 in the hub 18, said hole 21 connecting the cylinder-shaped recess 10 with the pump chamber 3. One purpose of said hole 21 is to allow for introduction of a suitable tool in order to connect the sleeve 12 to the drive shaft 11.

A central feature of the present invention is that the drive shaft unit 6 comprises an axially extending pin 22 that projects from the lower end 5 of the drive shaft unit 6. Said pin 22 is arranged in said hole 21 in order to prevent the pumped liquid from entering the cylinder-shaped recess 10 of the impeller 4. The axial displaceability of the impeller 4 in relation to the drive shaft unit 6 entails that even the hole 21 of the impeller 4 is axially displaceable in relation to the pin 22. A liquid sealing 23 is preferably arranged between said hole 21 and said pin 22 in order to prevent that the pumped liquid and solid matter enter the cylinder-shaped recess 10 from below. Hence, the pin 22 is always arranged in said hole 21, regardless of the mutual position of the impeller 4 and the drive shaft unit 6, respectively.

The liquid sealing 23 is preferably made up of an O-ring. The liquid sealing 23 is preferably arranged in a groove of an inner surface of the through-hole 21. As an alternative, the liquid sealing 23 may be arranged in a groove of a lateral surface 24 of the pin 22. The pin 22 preferably abuts an inner surface of the hole 21, whereby a further guidance between the impeller 4 and the drive shaft unit 6 is obtained. The guidance between the thicker part of the lower end 5 of the drive shaft unit 6 and the cylinder-shaped recess 10 of the impeller 4 combined with the guidance between the pin 22 and the hole 21 completely eliminate the risk of tilting the impeller 4 when an asymmetric force is axially applied on the latter.

The pin 22 is preferably connected to the sleeve 12, and in the shown, most preferred embodiment, the pin 22 is fixedly connected to the sleeve 12. The pin 22 is preferably tube-shaped and has a through-hole 25, the purpose of which is to allow introduction of a suitable tool so as to connect the sleeve 12 to the drive shaft 11. Furthermore, a plug or cover, not shown, may be inserted in the through-hole 25 of the pin 22 in order to prevent solid matter from entering and stopping up the bolt 14.

The pump preferably comprises a snap-lock coupling arranged at the interface between the drive shaft unit 6 and the cylinder-shaped recess 10. The snap-lock coupling is configured to position the impeller 4 in the lower position when an applied force acting to displace the impeller 4 in direction away from the lower position is below a threshold value. In the shown embodiments the snap-lock coupling comprises a seat 26 arranged at the interface between the lower, thicker part of the lower end 5 of the drive shaft unit 6 and the upper, thinner part of the lower end 5 of the drive shaft unit 6. The seat 26 of the snap-lock coupling is preferably delimited by a boss 27 belonging to the snap-lock coupling. Furthermore, a locking element 28 belonging to the snap-lock coupling is arranged in a recess 29 of the locking element, said recess 29 being arranged in the inner surface 16 of the cylinder-shaped recess 10 of the impeller 4. The locking element 28 is preferably made up of an annular spring and the recess 29 of the locking element is made up of a peripherally extending groove.

The annular spring 28 is arranged in the groove 29 and projects radially inwards in the cylinder-shaped recess 10 of the impeller 4, whereby the lower, thicker part of the lower end 5 of the drive shaft unit 6 is positioned below the annular spring 28. The impeller 4 is hereby prevented from falling off the drive shaft unit 6. Furthermore, at least a portion of the annular spring 28 is in engagement with the seat 26 of the snap-lock coupling whereby the impeller 4 is kept in its lower position. In other words, the boss 27 belonging to the snap-lock coupling is positioned above the annular spring 28.

The radius of the annular spring 28 preferably varies along its circumference and the spring has oval, triangular or quadratic basic shape, when viewed in axial direction. This entails that certain sections of the annular spring 28 are in contact with the seat 26 of the lower end 5 of the drive shaft unit 6 and further sections of the annular spring 28 are in contact with the recess 29 of the locking element of the cylinder-shaped recess 10 of the impeller. The variable radius entails that the annular spring 28 may be spring-biased both in the seat 26 and in the recess 29 of the locking element whereby an accurate positioning of the impeller 4 in its lower position without axial play is obtained. At the same time, a relatively small axially applied force is required for the boss 27 belonging to the snap-lock coupling to pass by the annular spring 28. The annular spring 28 preferably retains the rod 15 as well.

It should be mentioned that the annular spring 28 alternatively may have a circular basic shape. If a circle-shaped annular spring 28 is used then said spring cannot be spring-biased in the recess 29 of the locking element since the annular spring 28 must have space to expand radially outwards once the boss 27 belonging to the snap-lock coupling passes by the annular spring 28.

When a large piece of solid matter forces the impeller 4 to leave its lower position, no counteracting force is acting after the snap-lock coupling has disengaged. Once the solid matter has passed, the impeller 4 adopts the lower position due to presence of a higher hydraulic pressure on the upper side of the cover plate of the impeller compared to the lower side of the impeller 4, and in those cases the pump is vertically oriented, as shown in the figures, the own weight of the impeller 4 also acts to bring the impeller 4 back to its lower position. Once the impeller 4 has been displaced from its lower position, the annular spring 28 is accordingly still positioned in the recess 29 of the locking element, and once the impeller 4 returns to its lower position, the annular spring 28 is once more positioned in the seat 26 of the drive shaft unit 6.

Now, reference is made to FIG. 7 showing an embodiment of a suction cover 7.

At least one groove or clearance groove 30 is arranged in the upper surface of the suction cover 7 and the adjoining inlet 8 of the pump chamber 3. The groove 30 extends from the inlet 8 of the suction cover 7 towards its periphery. The groove 30 is preferably spiral-shaped and sweeps outwardly in the rotational direction of the impeller 4, i.e. in direction opposite to that of the rotating blades 20. The number of grooves 30 and their shape and orientation may vary significantly so as to fit different liquids and fields of application. The function of the groove 30 is to guide the solid matter in the pumped liquid outwardly, towards the periphery of the pump chamber 2. Some of the solid matter passing through the pump will get stuck underneath the blades 20 and reduce the rotational speed of the impeller, sometimes even downright completely stop its movement. The groove 30 contributes in keeping the blades 20 clean by scraping off the solid matter each time the blade 20 passes said groove. If the solid matter is too large to fit into the groove 30, between the impeller 4 and the suction cover 7, the impeller will, by means of the solid matter, be displaced upwards and away from the suction cover 7 allowing thereby the solid matter to pass through the pump.

The shape of the lower edge of the blade 20 corresponds in the axial direction to the shape of the upper surface of the suction cover 7. The axial distance between said lower edge and said upper surface should be less than 1 mm when the impeller 4 is in the lower position. Said distance is preferably less than 0.8 mm and most preferred less than 0.5 mm. Said distance should at the same time be greater than 0.1 mm and preferably greater than 0.2 mm. If the impeller 4 and the suction cover 7 are too close to each other, then a friction force or a brake force acts on the blade 20 of the impeller 4.

In order to ensure that the inlet 8 of the pump doesn't become obstructed, the suction cover 7 is preferably provided with means that guide the solid matter towards the groove 30. The guiding means comprise at least a guide pin 31 extending from the upper surface of the suction cover 7, more particularly from the section of the upper surface that faces the inlet 8. The guide pin 31 generally extends in the radial direction of the suction cover 7 and is positioned below the impeller and has an upper surface 32 that extends from a position adjoining the innermost part of the blade 20 of the impeller 4 towards or to the upper surface of the suction cover 7. More specifically, the innermost part of the upper surface 32 of the guide pin 31 is placed at approximately the same radial distance from the centrum of the impeller 4 as the innermost part of the blade 20 of the impeller 4. The upper surface 32 of the guide pin 31 preferably ends in immediate proximity of the "inlet" of said groove 30. When the impeller 4 is in the lower position, the axial distance between the upper surface 32 of the guide pin 31 and the leading edge of the blade 20 should be less than 1 mm.

The present invention also relates to an impeller assembly for placement in a pump chamber 3. Such an impeller assembly may be sold as an upgrading kit for a pump with axially displaceable impeller, said pump belonging to the prior art. The impeller assembly comprises an impeller 4 with a cylinder-shaped recess 10 and a sleeve 12. The sleeve 12 is received in said cylinder-shaped recess 10, wherein the sleeve 12 is arranged to be connected to an axially extending drive shaft 11. The impeller 4 is displaceable back and forth in the axial direction in relation to the sleeve 12. The impeller 4 further comprises an axially extending hole 21 that connects the cylinder-shaped recess 10 and the pump chamber, wherein the sleeve 12 comprises an axially extending pin 22 that projects from the sleeve 12. The pin 22 is arranged in said hole 21. In addition, everything that has been mentioned as regards the snap lock, the sleeve 12 and the impeller 4 is applicable to the impeller assembly as well. In this context, the sleeve 12 also belongs to the impeller assembly and when the impeller assembly is mounted on the drive shaft 11, the sleeve 12 belongs to the lower end 5 of the drive shaft unit 6.

Conceivable Modifications of the Invention

The invention is not limited only to the above-described embodiments nor to the embodiments featured in the drawings. In this context, the drawings only have an illustrative and exemplifying purpose. This patent application is intended to cover all adaptations and variants of the preferred embodiments described above. The present invention is consequently defined by the wording of the attached patent claims and may hence be modified in any conceivable way within the frame established by said claims.

It should also be noted that all information regarding terms such as above, below, upper, lower etc. should be construed with the equipment being oriented according to the figures, with drawings oriented in such a way that the reference numerals can be read in a correct manner. Thus, similar terms indicate only mutual relations in the shown embodiments, wherein these embodiments may be changed if the equipment of the present invention is provided with a different construction/design.

It should also be noted that although not explicitly stated that the feature(s) belonging to a specific embodiment may be combined with the feature(s) belonging to another embodiment, such a combination, if feasible, should be deemed obvious.

The invention claimed is:

1. A pump for pumping liquid, comprising a pump chamber and an impeller arranged to rotate in said pump chamber, said impeller suspended at a lower end of an axially extending drive shaft unit, with said lower end of the drive shaft unit received in a cylinder-shaped recess of the impeller, the impeller comprising an axially extending hole that connects the cylinder-shaped recess and the pump chamber, wherein the impeller, during operation of the pump, is displaceable back and forth in an axial direction in relation to the drive shaft unit and the drive shaft unit comprises an axially extending pin that projects from said lower end of the drive shaft unit, said pin arranged in said hole to prevent the pumped liquid from entering the cylinder-shaped recess of the impeller;

wherein the drive shaft unit comprises a drive shaft and a sleeve, wherein the sleeve surrounds and is releasably connected to the drive shaft and comprises part of the lower end of the drive shaft unit.

2. A pump according to claim 1, wherein a liquid seal is arranged at an interface of said hole and said pin.

3. A pump according to claim 2, wherein the liquid seal comprises an O-ring.

4. A pump according to claim 2, wherein the liquid seal is arranged in a groove of an inner surface of the hole.

5. A pump according to claim 1, wherein a lateral surface of the pin abuts an inner surface of the hole.

6. A pump according to claim 1, wherein an axial section of a lateral surface belonging to the lower end of the drive shaft unit abuts an inner surface of the cylinder-shaped recess.

7. A pump according to claim 1, wherein the pin is tube-shaped.

8. A pump according to claim 1, wherein said pin is fixedly connected to said sleeve.

9. A pump according to claim 1, wherein the impeller is an open impeller comprising a hub, an upper cover plate and at least one blade connected at least to said upper cover plate.

10. A pump according to claim 9, wherein said cylinder-shaped recess and said hole are arranged in the hub of the impeller.

11. An impeller assembly for placement in a pump chamber of a pump, comprising an impeller having a cylinder-shaped recess and a sleeve, said sleeve received in said cylinder-shaped recess and configured to be connected to an axially extending drive shaft, wherein the impeller, during operation of the pump, is displaceable back and forth in an axial direction in relation to the sleeve and the impeller comprises an axially extending hole that connects the cylinder-shaped recess and the pump chamber, the sleeve comprising an axially extending pin that projects from the sleeve, said pin arranged in said hole to prevent the pumped liquid from entering the cylinder-shaped recess of the impeller.

12. A pump for pumping liquid, comprising a pump chamber and an impeller arranged to rotate in said pump chamber, said impeller suspended at a lower end of an axially extending drive shaft unit, wherein the drive shaft unit comprises a drive shaft and a sleeve that surrounds and is connected to the drive shaft, wherein the sleeve comprises part of the lower end of the drive shaft unit, with said sleeve received in a cylinder-shaped recess of the impeller, the impeller comprising an axially extending hole that connects the cylinder-shaped recess and the pump chamber, wherein the impeller is automatically displaceable back and forth in an axial direction with respect to the drive shaft and the sleeve, and the drive shaft unit further comprises an axially extending pin that projects from said lower end of the drive shaft unit, said pin arranged in said hole to prevent the pumped liquid from entering the cylinder-shaped recess of the impeller.

* * * * *